US009937548B2

(12) United States Patent
Clarke et al.

(10) Patent No.: US 9,937,548 B2
(45) Date of Patent: Apr. 10, 2018

(54) JOINING APPARATUS AND METHOD

(75) Inventors: Christopher James Clarke, Tarporley (GB); Roger Stanton Doo, Hope (GB); Margaret Lucas, Kirkintilloch (GB); Russell John Trinick, Mold (GB)

(73) Assignee: Henrob Limited, Flintshire (GB)

( * ) Notice: Subject to any disclaimer, the term of this patent is extended or adjusted under 35 U.S.C. 154(b) by 865 days.

(21) Appl. No.: 13/056,299

(22) PCT Filed: Jun. 23, 2009

(86) PCT No.: PCT/GB2009/001572

§ 371 (c)(1),
(2), (4) Date: Jan. 27, 2011

(87) PCT Pub. No.: WO2010/012973

PCT Pub. Date: Feb. 4, 2010

(65) Prior Publication Data

US 2011/0126396 A1 Jun. 2, 2011

(30) Foreign Application Priority Data

Jul. 30, 2008 (GB) ..... 0813883.6

(51) Int. Cl.
*B21J 15/02* (2006.01)
*B21J 15/12* (2006.01)

(52) U.S. Cl.
CPC ..... *B21J 15/025* (2013.01); *B21J 15/12* (2013.01); *Y10T 29/49956* (2015.01); *Y10T 29/5377* (2015.01)

(58) Field of Classification Search
USPC ..... 29/524.1, 525.01, 525.05, 525.06, 798, 29/243.53, 243.54, 243.5, 715; 72/430,
(Continued)

(56) References Cited

U.S. PATENT DOCUMENTS 3,201,967 A 8/1965 Balamuth et al.
3,341,935 A 9/1967 Balamuth
(Continued)

FOREIGN PATENT DOCUMENTS

DE 19905527 7/1998
DE 19701088 8/2000
(Continued)

OTHER PUBLICATIONS

English machine translation of DE 19905527.*
(Continued)

*Primary Examiner* — Essama Omgba
(74) *Attorney, Agent, or Firm* — Michael Best & Friedrich LLP

(57) ABSTRACT

A joint is produced in at least two overlapping workpieces using a joining tool including a punch reciprocally disposed in a cylinder. The workpieces are disposed between the tool and a die. The tool applies a compressive force to deform the workpieces into a joint at a joining area between the tool and die. Continuous ultrasonic energy is applied to at least one of the workpieces in the joining area for at least part of the time during production of the joint to increase the ductility of at least one of the workpieces in the joining area. This induces an acousto-plastic effect in the material being formed which temporarily reduces its strength so as to exhibit increased ductility. The joining method may be used in self-piercing riveting and clinching techniques and enables viable joints to be formed in high strength materials or thick sheets of material.

27 Claims, 2 Drawing Sheets

(58) Field of Classification Search
USPC ..... 72/56, 710
See application file for complete search history.

(56) References Cited

U.S. PATENT DOCUMENTS

| | | | | |
|---|---|---|---|---|
| 3,376,179 | A | 4/1968 | Balamuth | |
| 3,483,611 | A | 12/1969 | Balamuth et al. | |
| 4,828,052 | A * | 5/1989 | Duran et al. | 175/55 |
| 6,199,271 | B1 * | 3/2001 | Hahn et al. | 29/715 |
| 6,684,479 | B2 * | 2/2004 | Wang et al. | 29/521 |
| 6,694,597 | B2 * | 2/2004 | Wang et al. | 29/525.06 |
| 6,742,235 | B2 | 6/2004 | Blacket et al. | |
| 6,862,913 | B2 * | 3/2005 | Lempenauer et al. | 72/430 |
| 7,555,833 | B2 * | 7/2009 | Wang et al. | 29/798 |
| 7,698,797 | B2 * | 4/2010 | Hetrick et al. | 29/505 |
| 7,870,656 | B2 * | 1/2011 | Eberlein | 29/525.14 |
| 8,033,151 | B2 * | 10/2011 | Castle et al. | 72/53 |
| 8,234,770 | B2 * | 8/2012 | Durandet et al. | 29/525.01 |
| 8,490,275 | B2 * | 7/2013 | Kott | 29/524.1 |
| 2001/0002506 | A1 * | 6/2001 | Hahn et al. | 29/407.1 |
| 2001/0025518 | A1 | 10/2001 | Hahn et al. | |
| 2002/0038504 | A1 * | 4/2002 | Engler et al. | 29/521 |
| 2003/0115927 | A1 * | 6/2003 | Lempenauer et al. | 72/430 |
| 2004/0093725 | A1 * | 5/2004 | Malolepszy et al. | 29/861 |
| 2005/0019137 | A1 | 1/2005 | Iwatsuki et al. | |
| 2006/0168792 | A1 * | 8/2006 | Reatherford et al. | 29/514 |
| 2006/0230609 | A1 * | 10/2006 | Wang et al. | 29/798 |
| 2010/0170078 | A1 * | 7/2010 | Kott | 29/525.06 |
| 2010/0257910 | A1 * | 10/2010 | Castle et al. | 72/57 |
| 2011/0126396 | A1 * | 6/2011 | Clarke et al. | 29/525.06 |

FOREIGN PATENT DOCUMENTS

| | | | | |
|---|---|---|---|---|
| DE | 102007007496 | | 6/2008 | |
| DE | 102011051301 | A1 * | 12/2012 | B21D 39/03 |
| EP | 0675774 | | 5/2004 | |
| EP | 2636465 | A1 * | 9/2013 | B21J 15/02 |
| GB | 2425179 | A * | 10/2006 | G01N 29/04 |
| JP | 10230378 | | 9/1998 | |
| JP | 2002121635 | | 4/2002 | |
| JP | 2002306488 | | 10/2002 | |
| JP | 2005205463 | | 8/2005 | |
| JP | 2005288457 | | 10/2005 | |
| JP | 2005349450 | | 12/2005 | |
| WO | 93/10925 | | 6/1993 | |
| WO | 95/35174 | | 12/1995 | |
| WO | WO 2006018415 | A2 * | 2/2006 | B23K 20/10 |
| WO | 2006/110089 | | 10/2006 | |
| WO | WO 2007137367 | A1 * | 12/2007 | B21J 15/00 |
| WO | WO 2010012973 | A1 * | 2/2010 | B21J 15/02 |

OTHER PUBLICATIONS

Cai M., "Acousto-Plastic Deformation of Metals by Nonlinear Stress Waves", The Ohio State University, PhD Thesis, 2006 (pp. 1-13, 195-198, 254 of this thesis were considered).

Daud M.Y., "Modelling contact friction under superimposed ultrasonic vibration in metal upsetting", Jun. 2004 , Glasgow University Postgraduate symposium (http://www.mech.gla.ac.uk/Research/Colloquia/Abstract.html?AbstractID=247).

Daud Y., Lucas M., Huang Z., "Modelling the effects of superimposed ultrasonic vibrations on tension and compression tests of aluminium", Journal of Materials Processing Technology, 2007, issue 186, pp. 179-190.

Hahn O., Krass B., et al, "Mechanical Joining with Dynamic Force Introduction", Sheet Metal Welding Sterling Heights, MI, May 11-14, 2004. Conference, Sterling Heights, MI, May 11-14, 2004.

"Krell Engineering" Extract from www.krell-engineering.com, Printed dated extract 2007.

Sapozhnikov K.V., Kustov S.B., "Acoustoplastic effect and internal friction of aluminum single crystals in various deformation stages", Physics of the Solid State, 1997, vol. 39, No. 10, pp. 1601-1606.

Wnek J., "Ultrasonic metal welding for wire splicing and termination" www.amtechultrasonic.com, Printed dated extract 2007.

International Search Report and Written Opinion of the International Searching Authority, International Patent Application No. PCT/GB2009/001572, dated Sep. 2, 2009.

* cited by examiner

JOINING APPARATUS AND METHOD

CROSS-REFERENCE TO RELATED APPLICATIONS

This application is a U.S. national phase application filing of International Patent Application No. PCT/GB2009/001572, filed Jun. 23, 2009, and published as WO 2010/012973 on Feb. 4, 2010, which claims the benefit of and priority to United Kingdom Patent Application No. 0813883.6, filed Jul. 30, 2008, the entire contents of each of the foregoing are incorporated herein by reference.

BACKGROUND OF THE INVENTION

I. Field of the Invention

The present invention relates to an apparatus and method for joining components together and more particularly, but not exclusively, to joining sheet material such as metals using rivets or the like.

II. Description of Related Art

Self-piercing riveting (SPR) is a well-established technique for joining together components such as, for example, sheet metal. A self-piercing rivet typically comprises a head and a partially hollow cylindrical shank that terminates in an annular piercing edge and is inserted into one or more sheets of material. The rivet is driven by a punch of a setting tool into the sheets such that that shank pierces through the upper sheet (or sheets) and flares outwardly whilst supported by a die. It is inserted without full penetration such that the deformed end of the rivet remains encapsulated by an upset annulus of the material thus forming a mechanical interlock. Since the lowermost sheet is not penetrated the joint has added resistance to corrosion. Self-piercing riveting enables sheet material to be joined without the requirement for the pre-drilling or pre-punching of a hole in the material.

Self-piercing riveting technology has application in many manufacturing industries but has been particularly successful in the automotive industry where there is a drive to use material of lighter weight without reducing safety. SPR has been used to join component parts such as aluminium vehicle body panels, which cannot be spot-welded easily. SPR techniques have proved successful in this context not only because they produce joints of good strength and fatigue properties that can be easily automated on a production line but also because the joints are aesthetically acceptable in that there is little distortion of the upper surface of the sheet material around the rivet.

SPR is faced with increasing challenges in terms of the types of joints that manufacturers would like to produce using the technology. For example, there is a trend to using higher strength sheet material compositions such as, for example, high strength steel and ultra-high strength steel (having an ultimate tensile strength of up to 1400 MPa or more). Moreover there is a desire to rivet thicker sheets or stacks of sheets. These developments have put increasing demands on SPR technology. Rivets can be made harder to withstand the insertion forces required to pierce the high strength metals but they then exhibit lower ductility and may be prone to fracture during the flaring stage of insertion. Advances in joining performance have been achieved by modifying such things as the rivet geometry, the heat treatment regime applied to it and the production techniques used to produce it but improvements of this kind are of increasingly small incremental steps. Moreover, the thicker and/or higher strength materials generally require increased setting forces in order to insert the rivet and thus put increased demands on the setting tools, the C-frame in which they are supported and the robotic handlers that carry the C-frame.

Attempts have been made to extend the limits of SPR by heat-treating the sheet material in the area to be joined so as to improve its formability. Techniques using induction coils or laser technology have been employed to provide a local application of heat but it has been found that the resulting modification to the microstructure of the metal provides a joint that has inferior mechanical properties compared to the remainder of the sheet. Other attempts have been made to alter the general properties of sheet metal material so that it is more suitable for SPR.

An alternative joining technique to self-piercing riveting is that of clinching whereby a punch is applied to the sheet material without the rivet present. The sheets are locally deformed out of their planes into a specially constructed die to form a "button" joint whereby they are mechanically interlocked to form a secure joint. Such joints are not generally as strong as joints formed by SPR and are most commonly used in relation to joining only two sheets. The desire to join stronger and thicker sheets of material presents clinching technology with similar problems to those described above in relation to SPR.

One approach to improving the capability of clinching or SPR techniques has been to use a percussion mechanism as part of the insertion tool to apply successive rapid impacts to the rivet or the sheet material. One example of this is described in U.S. Pat. No. 6,199,271 (Hahn). Another is described in U.S. Pat. No. 6,862,913 (DaimlerChrysler) in which rapid percussive impacts are applied by vibration of a punch or die longitudinally in the direction of sheet thickness at a high frequency in the ultrasonic range (so-called "vibro-impacting"). The impacts produce high peak forces during the phase where the punch deforms the material. After this, torsional oscillations are applied during a cold-upsetting phase in order to effect cold-pressure welding. It is presented that the process benefits from frictional heating generated by the ultrasonic vibrations and that this decreases the resistance to deformation of the parts during joining.

Ultrasonic energy has been used in other metal formation techniques such as forging, forming, welding, and dimpling of metals. Ultrasonic welding of non-ferrous metals can be achieved by application of vibrations parallel to the weld surface without application of heat and without melting the materials. The ultrasonic vibrations serve to disperse surface oxides and encourage plastic flow of the material such that the interface surfaces are deformed and key into each other. An example of metal forming using ultrasonic energy is described in U.S. Pat. No. 3,341,935 (Balamuth) in which a sheet metal is dimpled around a pre-drilled hole by application of a tool to the surface around the hole, the tool being vibrated at ultrasonic frequency to allow a transfer of energy. U.S. Pat. No. 3,483,611 (also Balamuth) discusses a riveting technique in which a rivet is first inserted into a component and then ultrasonic energy is applied to the rivet simultaneously with a static force to soften the rivet material so as to form a rivet head.

SUMMARY OF THE INVENTION

It is one object of the present invention, amongst others, to obviate or mitigate at least one of the aforementioned disadvantages and to provide for an improved joining method and apparatus.

According to a first aspect of the present invention there is provided a method for producing a joint in at least two overlapping workpieces using a joining tool comprising a punch to insert a self-piercing rivet into the workpieces to form the joint, the workpieces having a first surface that is nearest the tool, the method comprising placing the workpieces between the tool and a die, and positioning a rivet between the punch and the first surface, using the punch to insert the rivet into the at least two overlapping workpieces such that the first surface is pierced by the rivet, the punch applying a compressive force during rivet insertion to deform the workpieces into a joint at a joining area between the tool and the die, and applying continuous ultrasonic energy to at least one of the workpieces in the joining area for at least part of the time during production of the joint so as to increase the ductility of at least one of the workpieces in the joining area.

The application of ultrasound to the material being joined whilst applying a compressive force to deform the material via the rivet reduces the mean forming forces required for the joint. In particular, it induces a so-called acousto-plastic effect in the material being formed which temporarily reduces its strength so as to exhibit increased ductility. This is quite different from a thermal softening process in which heat energy is generated and absorbed into the material. With the acousto-plastic effect there is no softening of the material through significant increase in thermal energy levels but rather an almost instantaneous increase in ductility is achieved when only a small amount of acoustic energy is applied as a result of the energy being absorbed into lattice dislocations of the metal such that resistance to their movement is significantly reduced.

The separate application of ultrasonic energy in addition to applying a compressive deforming force can result in a vibro-impact technique in which the punch or die applies rapid and repeated impacts to the rivet or workpiece with repeated breaks in contact between the two. Alternatively it may result in continuous contact between the tool and/or the die and the workpiece so that the ultrasonic energy is continuously transmitted to the workpieces e.g. it may rely on a continuous acoustic coupling. Where the ultrasonic energy is applied via the punch, the nature of the contact is dependent on the velocity of the approach of the punch to the workpiece and the vibration velocity.

The application of ultrasonic energy in addition to applying a compressive deformation force affects the friction between the rivet and the first surface of the material being joined so as to lower the compressive force needed.

The workpieces may be sheet material or otherwise.

The at least two overlapping workpieces may comprise a first workpiece that is closest to the punch and a second workpiece that is closest to the die. There may be one or more intermediate workpieces between the first workpiece and the second workpiece. The rivet may be inserted such that the rivet does not penetrate the workpiece that is closest to the die. The rivet may pierce through at least a first workpiece that is closest to the punch and may also pierce through one or more intermediate workpieces. The rivet is inserted into the workpieces without full penetration (i.e. is does not pierce through the second workpiece) such that a deformed end of the rivet remains encapsulated by an upset annulus of the material.

The rivet may have a head and a shank, which may be hollow or partially hollow. Alternatively it may take the form of a solid slug with or without a head Alternatively, the joining method may be a clinching method in which the workpieces are deformed directly by a punch of the tool, without using a rivet, into a mechanically interlocked joint. A rivet or slug may be inserted into the clinched joint after it has been formed to provide additional strength. The rivet or slug may be inserted with or without applying ultrasonic energy to induce the acousto-plastic effect and/or reduce the force needed.

As a further alternative, the rivet or slug may be used to deform the workpiece and penetrate into the deformed region without piercing.

Ultrasonic energy may be applied during all of the time taken to form the joint, at several different times, or just part of that time. The energy level imparted to the workpiece(s) may vary during the formation of the joint. It may be applied by the punch or the die or both. It may be applied by a clamping feature including; for example, a nose of a rivet setting tool.

The ultrasonic energy may be applied to just the lowermost sheet (adjacent to the die) from the die, to several lower sheets from the die or to all the sheets from the die. Alternatively, it may be applied to only the uppermost sheet closest to the punch by the nose or punch, to several upper sheets or to all of the sheets. The energy may be applied through a rivet if present.

The ultrasound energy is preferably applied in a direction that is substantially the same as the compressive force that deforms the workpieces.

The workpieces may be clamped in a region around the joining area before, during and/or after deformation by the tool. Any suitable sequence and force profile of clamping may be applied. For example, the workpiece(s) may be pre-clamped with a high force sufficient to prevent significant deformation of the workpieces in the region around the joint. The pre-clamping force may be designed to ensure an appropriate level of acoustic contact between the workpieces. Alternatively, in an initial phase there may be no clamping force or a negligible clamping force applied and then a relatively high force applied just as the deformation is concluding (late-clamping) or just after it has concluded (post-clamping). In the case of a rivet being inserted, "conclusion" may be considered to be the point where the rivet is being driven home to complete the joint. The term "negligible" or "no" clamping force is intended to include a small force that is intended only to hold the workpiece steady during the forming operation or sufficient to hold the tool steady relative to the workpiece without it rattling.

According to a second aspect of the present invention there is provided joining apparatus for producing a riveted joint in at least two overlapping workpieces comprising a joining tool having a reciprocal punch disposed over a die over which the workpieces can be supported, the punch being movable towards the die for inserting a rivet into the workpieces and applying a compressive force to the workpieces in a joining area, at least one of the joining tool, the die or the workpieces being coupled to a source of ultrasonic energy so ultrasonic energy is applied to at least one of the workpieces in the joining area for at least part of the time during production of the joint so as to increase the ductility of at least one of the workpieces in the joining area.

The ultrasonic source may be coupled to at least one of the joining tool, die or the workpieces via an ultrasonic horn. The source may be a piezo-electric transducer and may be coupled to the ultrasonic horn via a booster that serves to amplify the amplitude of the ultrasonic waveform.

At least part of the die may be provided by at least part of the ultrasonic horn. For example, the ultrasonic horn may have a first surface that faces the workpiece and has a die cavity defined therein. Alternatively, the horn may be acoustically coupled to the die.

The die may be biased towards the punch by a biasing member.

The ultrasonic source may be coupled to the punch or a nose of the joining tool as an alternative to, or in addition to, it being coupled to the die. As a further alternative it may be coupled to a surface of at least one of the workpieces.

The nose is typically provided at one end of the joining tool and defines a contact surface for contacting the at least two overlapping workpieces whilst the production of the joint is effected. The punch may be reciprocally disposed such that it is movable relative to the nose between an extended position in which it extends towards the contact surface and a retracted position in which it does not extend from the nose and leaves space for a rivet to be positioned between the punch and the workpieces.

The nose may be operable to apply a clamping force of any magnitude or profile to the workpieces.

The ultrasonic source may be coupled to at least one of the joining tool and the die such that the ultrasonic energy propagates from the die to the joining area in a direction substantially parallel to the direction in which the compressive force is applied by the punch.

BRIEF DESCRIPTION OF THE DRAWINGS

Specific embodiments of the present invention will now be described, by way of example only, with reference to the accompanying drawings in which.

DETAILED DESCRIPTION

Figure 1:
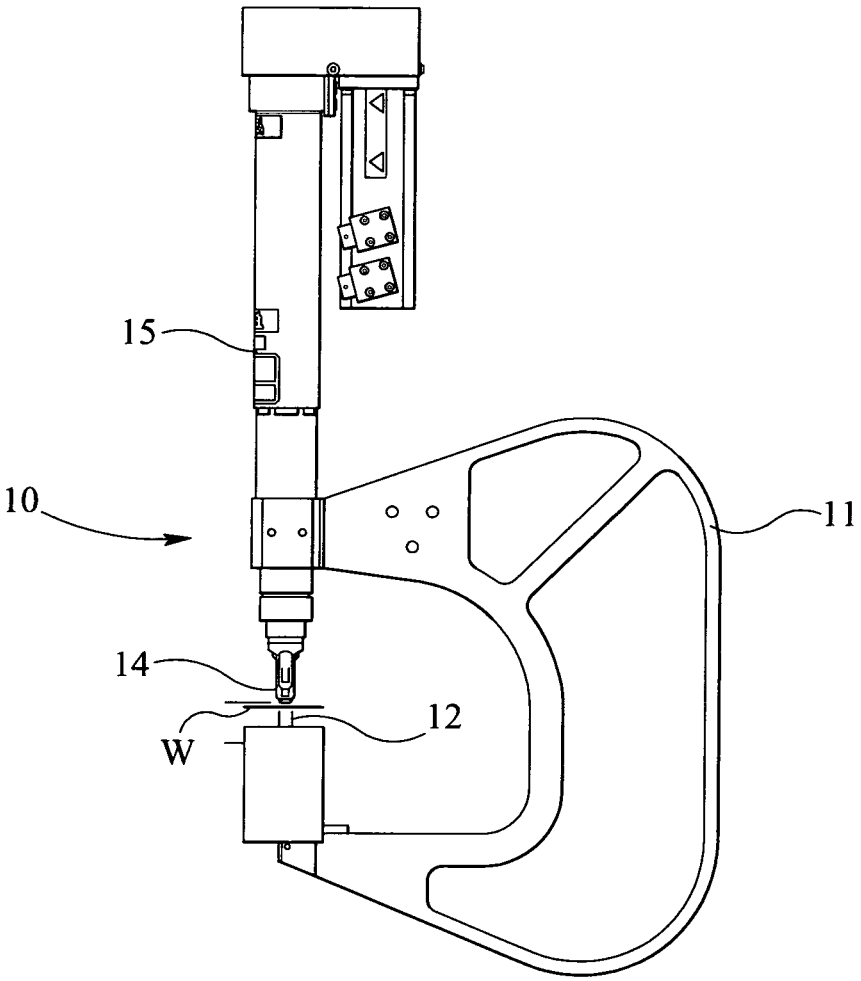
FIG. 1 is a side view of joining apparatus including a rivet setting tool supported over a die in a C-frame, in accordance with the present invention.
Figure 2:
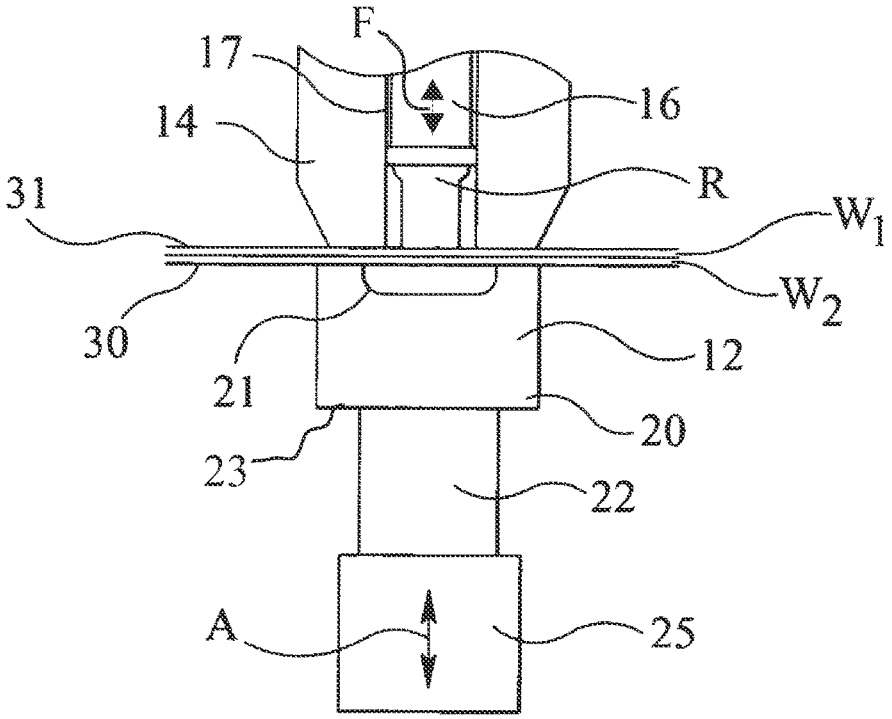
FIG. 2 is a schematic representation of part of the rivet setting tool in contact with two workpieces supported over a die and in which ultrasonic energy is applied via a die in accordance with the present invention.

Referring now to FIGS. 1 and 2 of the drawings, a rivet setting tool 10 is mounted on an upper arm of conventional C-frame 11 above a rivet-upsetting die 12 supported in the lower arm. Self-piercing rivets R (one shown in FIG. 2 only) are inserted by the tool 10 into workpieces W (FIG. 2) supported over the die 12 as is well known in the art. It is to be appreciated that whilst the specific embodiment described herein relates to the feeding and insertion of rivets it has application to other fasteners that are inserted into workpieces using a die such as, for example, slugs.

The C-frame 11 is mounted on a robot manipulator (not shown) such that it is movable with the tool 10 by the robot towards and away from the workpieces W as required. Feed apparatus (not shown) alongside the C-frame 11 is designed to supply rivets R to the setting tool 10 in a predetermined and controllable fashion from a bulk source. This may be achieved, by for example, using tape feed or a compressed gas (e.g. air) delivery system that propels the rivets along a tube or track. The control of the setting tool and the feed apparatus is normally via software. Such rivet supply systems and control systems are well known and will not therefore be described herein.

The setting tool 10 is of conventional configuration and so is not described in detail. In general terms, it comprises a cylindrical housing 15 that houses a reciprocal plunger that is driven in translation relative to the housing by a hydraulic, pneumatic or electric drive. The housing has an end nose portion 14 with an annular surface for contact with the workpieces W in which the joint is to be formed and the plunger terminates in a punch 16 that reciprocates in a passage 17 extending through the nose. In order to insert a rivet R into the workpieces W the plunger is driven so that the punch descends in the passage 17 extends beyond the nose 14 and comes into contact with a rivet R that has been fed to end of the passage 17 in the nose 14. Continued application of the force drives the punch 16 through the nose 14 so that the rivet R is inserted into the workpieces W.

In FIG. 2 the workpieces W are in the form of two sheet metal panels $W_1$, $W_2$ that lie one on top of the other over the die 12.

The tool 10 is operable such that the nose 14 moves downwards from the position shown in FIG. 1 to engage and optionally clamp the workpieces $W_1$, $W_2$ together as shown in FIG. 2.

The die 12 is generally cylindrical with a head 20 defining an open die cavity 21 for facing the setting tool punch 16 and a depending stem 22 that is of reduced diameter compared to the head such that an annular surface 23 extending radially relative to the central axis of the die 12 is defined on the underside of the head 20.

One specific embodiment of the die is shown in detail in FIG. 2. In this particular arrangement, the die 12 is connected to an ultrasonic horn 25 (also referred to as a "sonotrode"). The horn 25 is coupled to a piezo-electric transducer (not shown) that is configured to vibrate at a suitable ultrasonic frequency such as, for example, 20 kHz. This acoustic vibration is transmitted from the transducer to the horn 25 by a booster (not shown) that is interposed between them and is configured to amplify the amplitude of the vibrations by a predetermined gain factor. In this manner acoustic vibrations (represented by arrow A) propagate along the length of the die stem 22 to the surface of the die head 20 so that they are imparted to the lowermost workpiece $W_2$ by virtue of acoustic coupling between the die surface and the workpiece $W_2$, the vibration propagating in substantially the same direction as the compressive force (represented by arrow F) applied by the punch 16.

In operation the workpieces, which are represented in FIG. 2 by two sheets $W_1$, $W_2$ of overlying high strength steel, are introduced between the die 12 and the tool 10 such that they are supported over the die head 20 with a lower surface 30 of the lower sheet $W_2$ in contact with the surface of the die head 20. The setting tool 10 is then operated so that the nose 14 descends and is brought into contact with an upper surface 31 of the upper sheet $W_1$. The nose 14 applies a significant clamping force to compress the sheet material between it and the die 12. The force may be of such a magnitude that flow of material during the rivet insertion operation is affected. The longitudinal ultrasonic acoustic vibrations are transmitted to the lower sheet $W_2$ in the same general direction as the compressive force F applied by the punch and die combination and serve to increase the ductility of that sheet by virtue of the acousto-plastic effect. The setting tool 10 is then operated to drive the punch 16 downwards to insert the rivet R into the workpieces W as described above. As the rivet R is inserted, the plastic form of the lower sheet $W_2$ in the region of the joint enables the rivet shank to penetrate into the material and flare outwards sufficiently to provide a strong mechanical interlock without failure or cracking. It is inserted without full penetration of the lower sheet $W_2$ such that the deformed end of the rivet R remains encapsulated by an upset annulus of the material. The softening of the material caused by the acousto-plastic effect ceases almost immediately after the transducer 26 is turned off and the original properties of the sheet material return.

In the above described arrangement the ultrasonic acoustic energy is transmitted to the lower sheet $W_2$ by the horn 25 both before the insertion of the rivet R commences and during its insertion. In practice, the ultrasonic acoustic energy may be applied by the transducer at any appropriate stage during the rivet insertion process as determined by the control system. For example, the energy may be applied before the rivet R comes into contact with the upper sheet $W_1$, during contact, or at any stage between the rivet R starting to penetrate into the top sheet $W_1$ and it piercing through the top sheet $W_1$ so as to come into contact with the lower sheet $W_2$. It may be also applied for a short time after the rivet R has been fully inserted.

The ultrasonic acoustic energy may be applied at discrete time intervals during the rivet insertion for a given joint by turning the transducer on and off according to instructions programmed into the control system or according to feedback signals received during the insertion as a result of process monitoring. Moreover, the amplitude and/or frequency may vary during the insertion of a given rivet or may vary from joint to joint depending on its characteristics and the rivet type.

It will be understood that any magnitude of clamping force may be used. For example it may be sufficient to apply a force that is designed only to hold the sheets steady during the riveting operation. Alternatively the force could be much more significant than this in that it could affect the flow of sheet material in and around the joint during the rivet insertion process. The magnitude of the clamping force may vary during the rivet insertion operation in any suitable manner and in accordance with a program being followed by the control system. For example, the clamping force may be relatively large before and during rivet insertion or may be almost negligible for a predetermined part of the rivet insertion process before increasing in magnitude significantly. Some examples of force clamping profiles are described in our patents U.S. Pat. No. 6,742,235 and EP 0675774, the content of which are hereby incorporated by reference.

The die may be formed in its entirety by the ultrasonic horn or it may be defined only at the end of the horn. Moreover, it may simply be provided by a cavity defined in an end surface of the horn.

It will be appreciated that other ultrasonic frequencies may be used as opposed to 20 kHz. Any frequency in the range 18 kHz to 60 kHz is thought to be suitable, but preferably the frequency is in the range 20 to 40 kHz. The amplitude of the acoustic vibrations emitted by the piezo-electric transducer may typically be in the region of 8-10 μm but other amplitudes may be possible. The gain factor applied by the booster may be typically in the range 1.5 to 5 but other magnitudes are possible.

In an alternative embodiment a cross-coupled booster is used so its input and output vibrations are out of alignment i.e. they may be disposed such that the transducer vibrations propagate in a direction that is 90 degrees to those propagating in the horn. In this arrangement the transducer and booster may lie along the lower arm of the C-frame 11 whilst the horn 25 extends upwardly towards the joint forming area as before.

In a further alternative embodiment ultrasonic acoustic energy may be applied to the upper sheet $W_1$ at the same time as it is applied to the lower sheet $W_2$ by the die 12. For this purpose a second ultrasonic horn is fitted in the nose 14 and/or the punch 16 so that ultrasonic energy may be imparted to the upper sheet $W_1$ at least. In the case of the nose 14, the energy is imparted into the region around the rivet. In the case of the punch the energy is transmitted through the rivet. In a yet further arrangement, only a single transducer is provided on the tool side so that the energy may be transmitted only via the nose and/or punch to the upper sheet $W_1$.

By suitable control of the frequency and ultrasonic amplitude under load using an ultrasonic generator with resonance tracking capability the acoustic energy may be transmitted to all sheets W in the stack either by applying the ultrasonic energy at the die, via the nose or via the punch and rivet.

Figure 3:
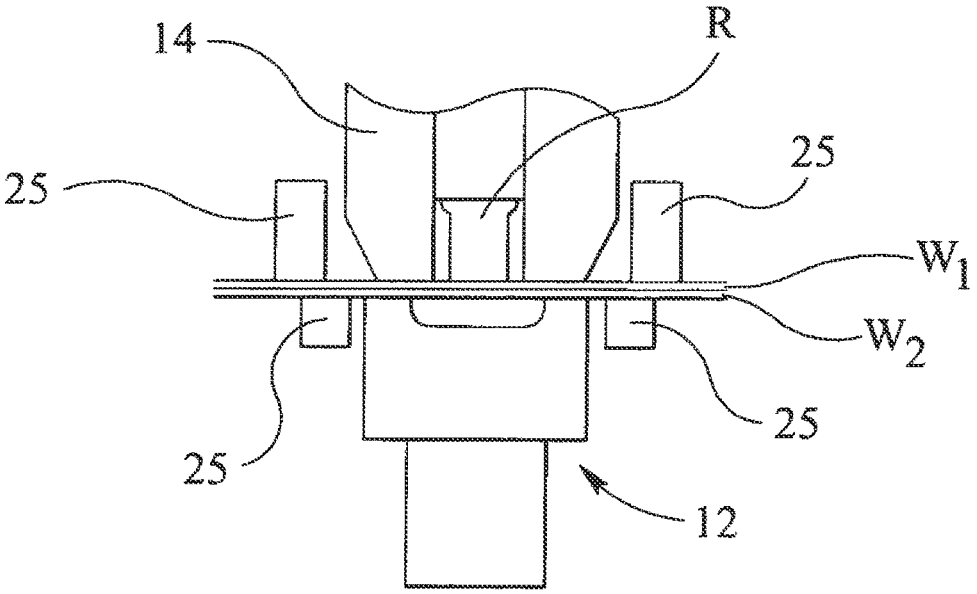
FIG. 3 is a schematic representation of part of an alternative embodiment of the invention in which ultrasonic energy is applied directly to the workpieces.

In FIG. 3, there is illustrated an alternative arrangement in which ultrasonic horns 25 are arranged to make direct contact with the upper sheet $W_1$ and lower sheet $W_2$ so that ultrasonic energy is imparted independently of the nose/punch or die. The horns in this instance are depicted as annular such that they surround the joining area but may take any suitable form. It is to be appreciated that only one of the horns may be used in practice.

The above-described methods may be applied to clinching operations where the workpiece is deformed out of its plane into a die directly by a punch without using a rivet. Once the sheets are deformed into the button joint a rivet or slug may be inserted to strengthen the joint. Examples of clinching techniques to which the present invention is applicable are described in our patents stemming from WO93/10925, the content of which is incorporated herein by reference.

The methods described above allow SPR and clinching to be used to form joints in higher strength materials (e.g. Ultra High Strength Steels or austenitic stainless steel 301, 316) or thicker materials than is currently possible. Joints can be made with lower compression (insertion) forces applied by the punch. This has several advantages, in particular C-frames can be made lighter thereby improving accessibility and cost. The rivet setting and clinching tools may be lighter and smaller, thereby reducing the size and cost of robot handling equipment. This in turn allows higher speed robot movements so that cycle times are reduced. Lower hardness rivets can be used and the improved ductility of the rivet reduces the frequency of failure by tearing, cracking or other fractures.

Numerous modifications and variations to the embodiment described above may be made without departing from the scope of the invention as defined in the appended claims. For example, the source of ultrasonic energy may be provided by any suitable transducer besides a piezo-electric transducer such as, for example, a magnetostrictive transducer. Furthermore, the die may take any suitable form suitable for reacting the insertion forces, including a flat surface.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

The invention claimed is:

1. A method for producing a joint in at least two overlapping workpieces using a joining tool including a punch to insert a self-piercing rivet into the workpieces to form the joint, the workpieces having a first surface that is nearest the tool, the method comprising:

placing the workpieces between the tool and a die, positioning a rivet between the punch and the first surface, using the punch to insert the rivet into the at least two overlapping workpieces such that the first surface is pierced by the rivet, the punch applying a compressive force during rivet insertion to deform the workpieces into a joint at a joining area between the tool and the die, and applying continuous ultrasonic energy to at least one of the workpieces in the joining area around a perimeter of the rivet for at least part of the time during production of the joint so as to increase the ductility of at least one of the workpieces in the joining area due to the acousto-plastic effect, wherein the ultrasonic energy is applied by the die, or by a nose of the tool.

2. A method according to claim 1, wherein the at least two overlapping workpieces comprise a first workpiece that is nearest to the tool and a second workpiece that is nearest to the die, the rivet being inserted such that it does not penetrate through the second workpiece.

3. A method according to claim 2, wherein one or more intermediate workpieces are provided between the first workpiece and the second workpiece.

4. A method according to claim 1, wherein the die forms at least part of an ultrasonic horn.

5. A method according to claim 1, wherein the ultrasonic energy is applied directly to at least one of the workpieces.

6. A method according to claim 1, wherein the energy level imparted to the workpieces varies during the formation of the joint.

7. A method according to claim 1, wherein the ultrasonic energy is applied to only one of the workpieces.

8. A method according to claim 7, wherein the ultrasonic energy is applied to only the one workpiece nearest to the tool.

9. A method according to claim 7, wherein the ultrasonic energy is applied to only the one workpiece that is supported over the die.

10. A method according to claim 1, wherein the ultrasonic energy is applied in a direction that is substantially the same as the direction of the compressive force that deforms the workpieces.

11. A method according to claim 1, wherein the workpieces are clamped between the tool and the die by a clamping force in a region around the joining area for at least part of the time it takes to produce the joint.

12. A method according to claim 1, wherein substantially no clamping force is applied whilst the material is deformed by application of the compressive force and a clamping force is applied after production of the joint.

13. A method according to claim 12, wherein the clamping force applied after production of the joint is of such a magnitude that it reduces deformation in at least a first surface of the workpieces.

14. A method according to claim 1, wherein at least one of the workpieces is metal.

15. A method according to claim 1, wherein the ultrasonic energy is an acoustic vibration signal that is transmitted to the workpieces.

16. A method according to claim 15, wherein the acoustic vibration signal has a frequency in the range of 18 to 60 kHz.

17. A method according to claim 15, wherein the acoustic vibration signal has an amplitude of 2-50 μm.

18. A joining apparatus for producing a riveted joint in at least two overlapping workpieces, the joining apparatus comprising:

a joining tool having a reciprocal punch disposed over a die over which the workpieces can be supported, the punch being movable towards the die for inserting a rivet into the workpieces and applying a compressive force to the workpieces in a joining area, at least one of a nose of the joining tool and the die being coupled to a source of ultrasonic energy so that it can apply ultrasonic energy to at least one of the workpieces in the joining area around a perimeter of the rivet for at least part of the time during production of the joint so as to increase the ductility of at least one of the workpieces in the joining area due to the acousto-plastic effect.

19. A joining apparatus according to claim 18, wherein the ultrasonic source is coupled to at least one of the nose of the joining tool and the die via an ultrasonic horn.

20. A joining apparatus according to claim 19, wherein at least part of the die is provided by at least part of the ultrasonic horn.

21. A joining apparatus according to claim 20, wherein the ultrasonic horn has a first surface that faces the workpiece and has a die cavity defined therein.

22. A joining apparatus according to claim 18, wherein the die is biased towards the punch by a biasing member.

23. A joining apparatus according to claim 18, wherein the nose is configured for contacting workpieces, and the punch is reciprocally disposed such that it is movable between an extended position in which it extends from the nose and a retracted position in which it does not extend from the nose, and wherein the ultrasonic source is coupled to the nose.

24. A joining apparatus according to claim 23, wherein the nose is operable to apply a clamping force to the workpieces.

25. A joining apparatus according to claim 18, wherein the ultrasonic source is coupled to at least one of the nose of the joining tool and the die such that the ultrasonic energy is applied to the joining area in a direction that is substantially the same as the direction of the compressive force applied by the punch to deform the workpieces.

26. A method for producing a joint in at least two overlapping workpieces using a joining tool including a punch to insert a self-piercing rivet into the workpieces to form the joint, the workpieces having a first surface that is nearest the tool, the method comprising:

placing the workpieces between the tool and a die;

positioning a rivet between the punch and the first surface;

using the punch to insert the rivet into the at least two overlapping workpieces such that the first surface is pierced by the rivet, the punch applying a compressive force during rivet insertion to deform the workpieces into a joint at a joining area between the tool and the die; and applying continuous ultrasonic energy to at least one of the workpieces in the joining area around a perimeter of the rivet for at least part of the time during production of the joint so as to increase the ductility of at least one of the workpieces in the joining area, wherein the ultrasonic energy is not applied by the punch.

27. The method of claim 26, wherein continuous ultrasonic energy is not applied to the rivet.

* * * * *